US008474383B1

(12) United States Patent
Berg et al.

(10) Patent No.: US 8,474,383 B1
(45) Date of Patent: Jul. 2, 2013

(54) TRANSOM FOR A RAILWAY CAR TRUCK

(75) Inventors: Thomas R. Berg, St. Louis, MO (US); George Currier, Piscataway, NJ (US); Larry Hixon, Pittstown, NJ (US); Kevin McGarvey, Piscataway, NJ (US); Jason Reiling, Hillsborough, NJ (US)

(73) Assignee: Strato, Inc., Piscataway, NJ (US)

( * ) Notice: Subject to any disclaimer, the term of this patent is extended or adjusted under 35 U.S.C. 154(b) by 0 days.

(21) Appl. No.: 13/600,560

(22) Filed: Aug. 31, 2012

(51) Int. Cl.
*B61F 5/00* (2006.01)

(52) U.S. Cl.
USPC ..... 105/208; 105/208.1; 105/208.2

(58) Field of Classification Search
USPC ..... 105/208.1, 208.2
See application file for complete search history.

(56) References Cited

U.S. PATENT DOCUMENTS 3,358,615 A * 12/1967 Williams ..... 105/197.05
3,461,814 A 8/1969 Weber
3,548,755 A 12/1970 Lich
3,670,660 A * 6/1972 Weber et al. ..... 105/171
3,789,770 A 2/1974 List
3,965,825 A 6/1976 Sherrick
4,003,316 A 1/1977 Monselle
4,030,424 A 6/1977 Garner
4,131,069 A 12/1978 List
4,278,030 A 7/1981 Ahlborn
4,416,203 A 11/1983 Sherrick
4,483,253 A 11/1984 List
4,570,544 A 2/1986 Smith
4,674,412 A 6/1987 Mulcahy
4,938,152 A 7/1990 List
5,027,716 A 7/1991 Weber
5,222,441 A * 6/1993 Weber ..... 105/208
5,237,933 A 8/1993 Bucksbee
5,241,913 A 9/1993 Weber
5,243,920 A 9/1993 Lamson
5,461,986 A 10/1995 Sarnicki
5,463,964 A 11/1995 Long
5,503,084 A 4/1996 Goding
5,509,358 A 4/1996 Hawthorne
5,562,044 A 10/1996 Wiebe
5,562,045 A 10/1996 Rudibaugh
5,647,283 A 7/1997 McKisle
5,722,327 A 3/1998 Hawthorne
5,735,216 A 4/1998 Bullock
5,746,137 A 5/1998 Hawthorne
5,799,582 A 9/1998 Rudibaugh
5,802,982 A 9/1998 Weber
5,832,838 A 11/1998 Shaw
5,893,330 A 4/1999 Emery
5,918,547 A 7/1999 Bullock
5,924,366 A 7/1999 Trainer
5,943,960 A 8/1999 Becker
6,006,674 A 12/1999 Ahmadian
6,035,788 A 3/2000 Mau
6,053,840 A 4/2000 Jones
6,092,469 A 7/2000 Monsell
6,102,574 A 8/2000 Proschel (Continued)

OTHER PUBLICATIONS

AAR Manual of Standards and Recommended Practices, Truck Performance for Rail Cars, Specification M-976, Sep. 2010.

*Primary Examiner* — Jason C Smith
(74) *Attorney, Agent, or Firm* — Brendan Mee Law, P.C.

(57) ABSTRACT

The invention relates to a railway car truck incorporating a novel transom attached below the spring seat, having elastomeric fittings and a central opening to receive the truck bolster.

10 Claims, 5 Drawing Sheets

U.S. PATENT DOCUMENTS

| | | | | |
|---|---|---|---|---|
| 6,119,602 | A | 9/2000 | Yoshino | |
| 6,142,081 | A | 11/2000 | Long | |
| 6,148,734 | A | 11/2000 | Gwinn | |
| 6,178,894 | B1 | 1/2001 | Leingang | |
| 6,189,456 | B1 | 2/2001 | Smith | |
| 6,234,083 | B1 | 5/2001 | Tack | |
| 6,347,588 | B1 | 2/2002 | Leingang | |
| 6,357,360 | B1 | 3/2002 | Arnswald | |
| 6,371,033 | B1 | 4/2002 | Smith | |
| 6,422,155 | B1 | 7/2002 | Heyden | |
| 6,439,130 | B1 | 8/2002 | Scheffel | |
| 6,672,224 | B2 * | 1/2004 | Weber et al. | 105/187 |
| 6,817,301 | B1 | 11/2004 | Bullock | |
| 6,871,598 | B2 | 3/2005 | Schaller | |
| 6,874,426 | B2 | 4/2005 | Forbes | |
| 6,910,426 | B2 | 6/2005 | Krishnaswami | |
| 7,143,700 | B2 | 12/2006 | Forbes | |
| 7,174,837 | B2 | 2/2007 | Berg | |
| 7,231,878 | B2 | 6/2007 | Wike | |
| 7,263,930 | B2 | 9/2007 | Pershwitz | |
| 7,308,855 | B2 | 12/2007 | Van Auken | |
| 7,387,074 | B2 | 6/2008 | Myers | |
| 7,448,329 | B2 | 11/2008 | Muller | |
| 7,497,169 | B2 | 3/2009 | Forbes | |
| 7,513,199 | B2 | 4/2009 | Van Auken | |
| 7,527,131 | B1 | 5/2009 | Wike | |
| 7,533,617 | B2 | 5/2009 | Krautzig | |
| 7,654,204 | B2 * | 2/2010 | Forbes | 105/190.1 |
| 7,739,961 | B2 | 6/2010 | East | |
| 7,798,069 | B2 | 9/2010 | Aitken | |
| 7,845,288 | B2 | 12/2010 | Forbes | |
| 8,011,306 | B2 * | 9/2011 | Forbes | 105/197.05 |
| 8,047,139 | B2 | 11/2011 | Gedenek | |

* cited by examiner

FIG. 2
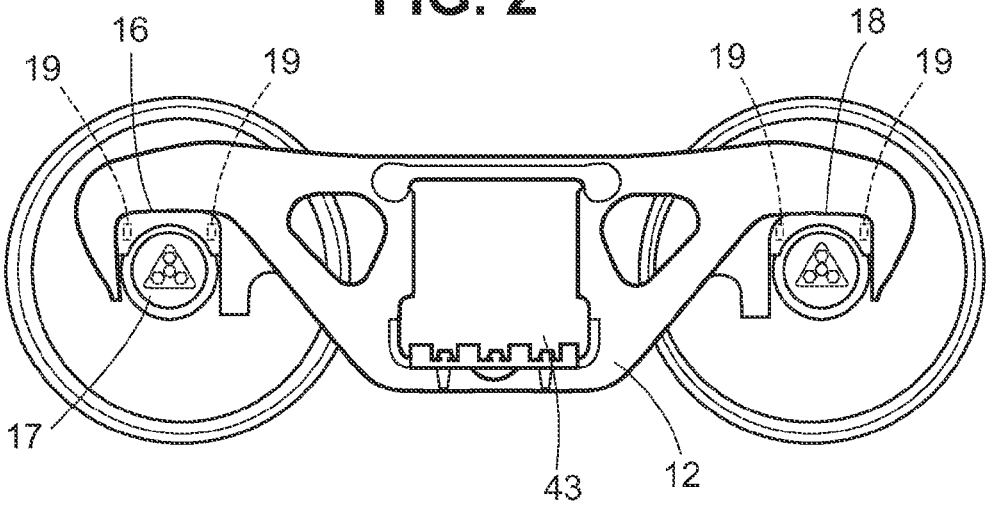
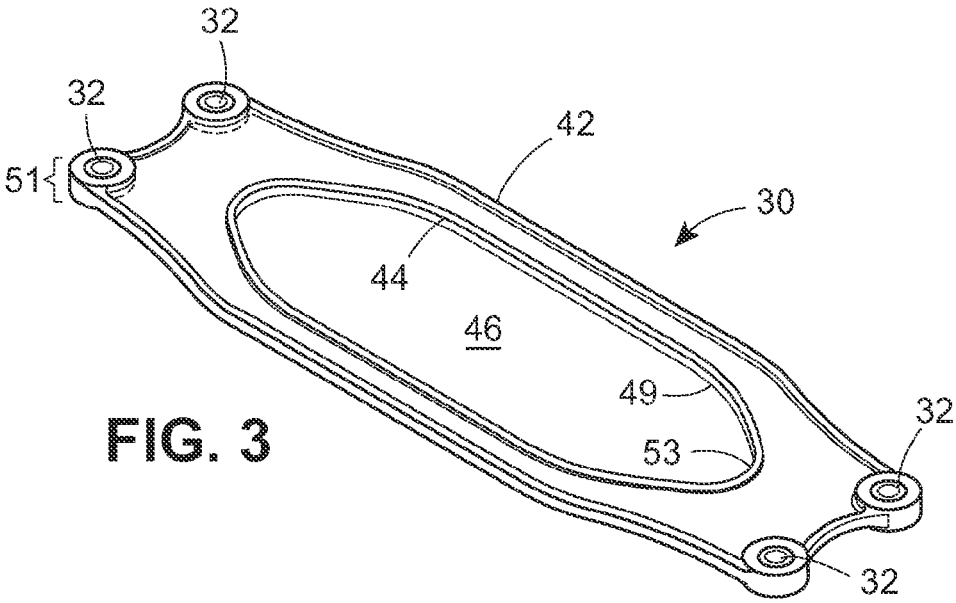
FIG. 3
FIG. 4
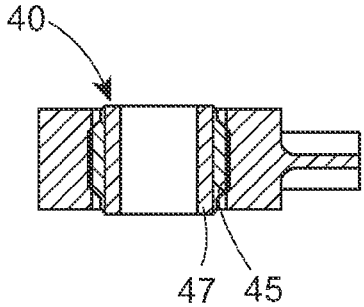

TRANSOM FOR A RAILWAY CAR TRUCK

BACKGROUND OF THE INVENTION

1. Field of the Invention

The invention relates to a railway car truck incorporating a novel transom, which provides the truck with a soft spring rate vertically as compared to a truck having a conventional spring plank or transom design, yet with a desired rigidity laterally and longitudinally, with a corresponding improvement in truck performance.

2. Description of the Related Art

The conventional railway freight car truck in use in North America for several decades has been the three piece truck, comprising a pair of parallel side frames connected by a transversely mounted bolster. The bolster is supported on the side frames by spring sets. The wheelsets of the truck are received in bearing adapters placed in leading and trailing pedestal jaws in the side frame, so that axles of the wheelsets are parallel. The railway car is mounted on the center plate of the bolster, which allows the truck to pivot with respect to the car. The spring sets permit the side frames to move somewhat with respect to the bolster, about the longitudinal, vertical and transverse axes.

It has long been desired to improve the performance of the three piece truck. Resistance to lateral and longitudinal loads and truck performance can be characterized in terms of one or more of the following well-known phenomena.

"Parallelogramming" occurs when one side frame moves forward longitudinally with respect to the other, such that the inboard and outboard wheel sets remain parallel to each other but they are not perpendicular to the rails, as may happen when a railway car truck encounters a turn.

"Hunting" describes an oscillating lateral movement of the wheelsets that causes the railcar to move side-to-side. Hunting may be dangerous when the oscillations attain a resonant frequency. Hunting is more likely to occur when there is a lack of proper alignment in the truck as made, or developed over time through various operating conditions. Hunting is also more likely to occur when the railcar is operated at higher speeds. The speed at which hunting is observed to occur is referred to as the "hunting threshold."

Several approaches have been tried to improve the lateral stability of the standard three piece truck to prevent parallelogramming and hunting, while at the same time ensuring that the truck is able to deform appropriately to accommodate the different distances traveled by the wheels on the inside and outside of a turn, respectively. Conventionally, a "spring plank" was laid on the side frames underneath the springs to prevent parallelogramming of the truck. The spring plank was kept in place by the weight of the overlying freight car on the bolster through the spring sets. Spring planks came to be used less frequency after roller bearings replaced journal bearings in wide usage. However, some truck designs continued to utilize variations of the transom or spring plank concept, as described below.

U.S. Pat. No. 3,461,814 to Weber references several milestones in the history of the spring plank, and discloses an improvement thereon referred to as a "roll control" truck. In the roll control truck, a spring plank is positioned on the spring seats of the side frames and is provided with an aperture for receiving a lug protruding downward from the bolster. The engagement of the bolster with the spring plank via the lug at this low point ensures that lateral forces are transferred to the side frames at a lower point on the truck, closer to the rails, which according to the patentee, improves car roll performance. The position of the spring plank underneath the springs in the spring seat of the side frame is typical of the prior art spring plank.

U.S. Pat. No. 3,670,660, also to Weber, discloses a "swing motion" truck, which is a modification of the roll control truck, wherein a rocker seat is interposed between the spring plank and the side frame, along with "rockably journaled" roller bearing adapters, which enables the side frames to rock in unison to accommodate lateral forces. As with the aforementioned roll control truck, the swing motion truck is characterized by the position of the spring plank over the spring seats of the side frames.

In a later development of the swing motion truck, described in U.S. Pat. No. 5,027,716, also to Weber, the patentee noted certain drawbacks of the swing motion truck, specifically in the mating of the rocker seat and the transom, which tended to reduce the rigidity of the truck average. In the design depicted in the '716 patent, the springs are seated directly on the rocker seat, and the spring plank is replaced with a pair of transverse support rods received in anchor brackets with elastomeric pads, such that the rocker seats are interconnected by the support rods to provide lateral rigidity to the truck.

Also known in the art are so-called "steerable" trucks, which allow a degree of rotation of each wheelset about a vertical axis so that the wheelsets may take an out-of-square position with respect to a longitudinal axis of the truck, permitting a truck to negotiate a turn. The invention described herein may be used with steerable and non-steerable trucks. U.S. Pat. No. 4,003,316 to Monselle, for example, depicts a type of steerable truck having a transom/bolster assembly, with elastomeric pads provided in the side frame opening between the transom/bolster assembly and the side frame for wheel load equalization. Combining the bolster and transom in the manner of the '316 patent adds complexity to the truck design and complicates the servicing of the truck parts. The steering mechanism itself is also complicated and costly.

U.S. Pat. No. 4,131,069, to List, also discloses a steerable truck, and is more typical of steerable truck designs generally. In the disclosed embodiments, the wheelsets of a truck are joined by an arm which controls and maintains the relationship between the wheelsets. The arm is further connected to a body of the railroad car so that movement between the car body and the wheelsets is maintained in a fixed relationship. In this case the steering arms, rather than a spring plank or transom, provide the lateral rigidity, which according to the patentee, is required to avoid hunting.

U.S. Pat. No. 4,483,253, also to List, describes a retrofit of then existing truck designs (i.e., for non-steerable trucks) which is said by the patentee to provide some of the advantages of the steerable truck at lower cost. The '253 patent discloses using a spring plank connecting the side frames of a truck provide lateral stability in combination with elastomeric pads provided in the pedestal jaws to provide some flexibility between the axles and the side frames of a truck. This combination is presented as a retrofit to then existing truck designs, which is alleged by the patentee to provide a non-steerable truck with better turn-negotiating capability. The spring plank is located in the conventional manner under the springs or ridgidly connected to each side frame.

U.S. Pat. No. 4,938,152, also to List, is in the same patent family as the aforesaid U.S. Pat. Nos. 4,131,069 and 4,483,253, and also contains additional disclosure. The '152 patent contemplates truck designs including a "shear plate," or transom, rigidly connecting the side frames and elastomeric pads in the pedestal jaws of the truck. Several modes of attaching the shear plate to the side frames are disclosed, so that it is not necessary to lay the shear plate under the springs. However, in all cases, the connection between the shear plate and the side frames is required to be completely rigid and the shear plate is located beneath the bolster, which creates another potential clearance problem.

Diagonal braces have been tried as an alternative to the conventional transom to provide resistance to parallelogramming while at the same time providing flexibility to adjust for the farces encountered on a curve. U.S. Pat. Nos. 5,461,986 and 4,570,544 both disclose diagonal brace designs. In both cases, the diagonal members utilize brackets to attach to the side frame. Brackets are needed to pitch the braces beneath the bolster. One drawback of diagonal braces is that they cross in the middle and therefore must be located underneath the bolster which creates a problem with respect to clearance. Alternatively, a means is provided to attach the braces to the bolster where the braces cross. In some cases, through holes have been provided in the bolster to accommodate the braces, which may weaken the bolster.

In light of the foregoing, one object of the invention is to provide rigidity to a three piece truck without impacting vertical clearance between the truck and the track. This clearance is set by AAR standards, in any event, and may not be less than 2¾ inches with springs solid and with maximum wear condition.

Another object of the invention is to provide a transom which provides rigidity to the truck while still providing sufficient torsional flexibility so that the truck meets the AAR wheel load equalization requirements.

Still another object of the invention is to provide a transom which does not interfere with the operation of the springs, the brake or other equipment associated with the truck.

In yet another aspect, the invention is directed to an improved truck, including the transom as described herein, and also including a modified bearing adapter wheelset interconnection, which provides a controlled ratio of lateral versus longitudinal spring rate between the side frames and bearing adapter, as described in co-pending application Ser. No. 13/600,693, filed on even date herewith and incorporated by reference in its entirety.

These and other objects of the invention are achieved according to the invention as follows.

SUMMARY OF THE INVENTION

In one aspect, the invention is a railway car truck incorporating a novel transom design. The railway car truck includes a pair of side frames, each having a leading pedestal jaw and a trailing pedestal jaw. The side frames are in an opposed relationship and parallel, and the respective leading and trailing pedestal jaws of the side frames are aligned so that transversely mounted wheel sets mounted in the pedestal jaws are also parallel, as practiced in the prior art. In this state, where the axles and the side frames are parallel, the truck is referred to as "square."

According to the invention, the spring seat is located in the side frame between the pedestal jaws, and a spring seat lip is cantilevered laterally inboard from the side wall of each side frame at the respective spring seats. A bolster arranged transversely between the first and second side frames is received in the side frames where the spring seats are located. A transom is attached to the first and second side frames such that the top surface of the transom is attached below the spring seat lip. The transom has a central cutout section receiving a lower portion of the bolster.

An elastomeric member provided contacting the transom so that lateral and longitudinal load applied to the transom is transferred to the side frame through the elastomeric member.

In embodiments, through holes are provided on the transom so that the transom can be bolted below the spring seat lip, and the elastomeric material is provided in the form of a tubular member inserted in the through hole and contacting the side walls of the through hole, so that force applied to the transom is transferred to the side frame via a bolt or other attachment member, cushioned by the elastomeric material in the through hole.

BRIEF DESCRIPTION OF THE FIGURES

FIG. 2 is a side view of the truck with the bolster removed.

FIG. 3 is an isometric view of a transom according to an embodiment of the invention.

FIG. 4 is a cross-sectional detail of a portion of the transom showing a through hole with an elastomeric bushing inserted therein.

DETAILED DESCRIPTION OF THE PREFERRED EMBODIMENTS

Directions and orientations herein are provided with reference to the normal orientation of a railway car in use. Thus, unless the context clearly requires otherwise, the "longitudinal" axis or direction is parallel to the rails and in the direction of movement of the railway car on the track in either direction. The "transverse" or "lateral" axis or direction is in a horizontal plane perpendicular to the longitudinal axis and the rail. The ter "inboard" means toward the center of the car, and may mean inboard in a longitudinal direction or a lateral direction or both. Similarly, "outboard" means away from the center of the car. "Vertical" is the up-and-down direction, and "horizontal" is a plane parallel to the rails, including the transverse and longitudinal axes. A truck is considered to be "square" when its wheels are aligned on parallel tracks and the axles are parallel to each other and perpendicular to the side frames. The "leading" side of the truck means the first side of a truck on a railway car to encounter a turn; and the "trailing" side is opposite the leading side.

Where a railway car truck according to the invention includes a plurality of substantially identical elements, such as two side frames, two wheelsets, four wheels, etc it is understood that a description of one element herein serves to describe all of them.

Figure 1:
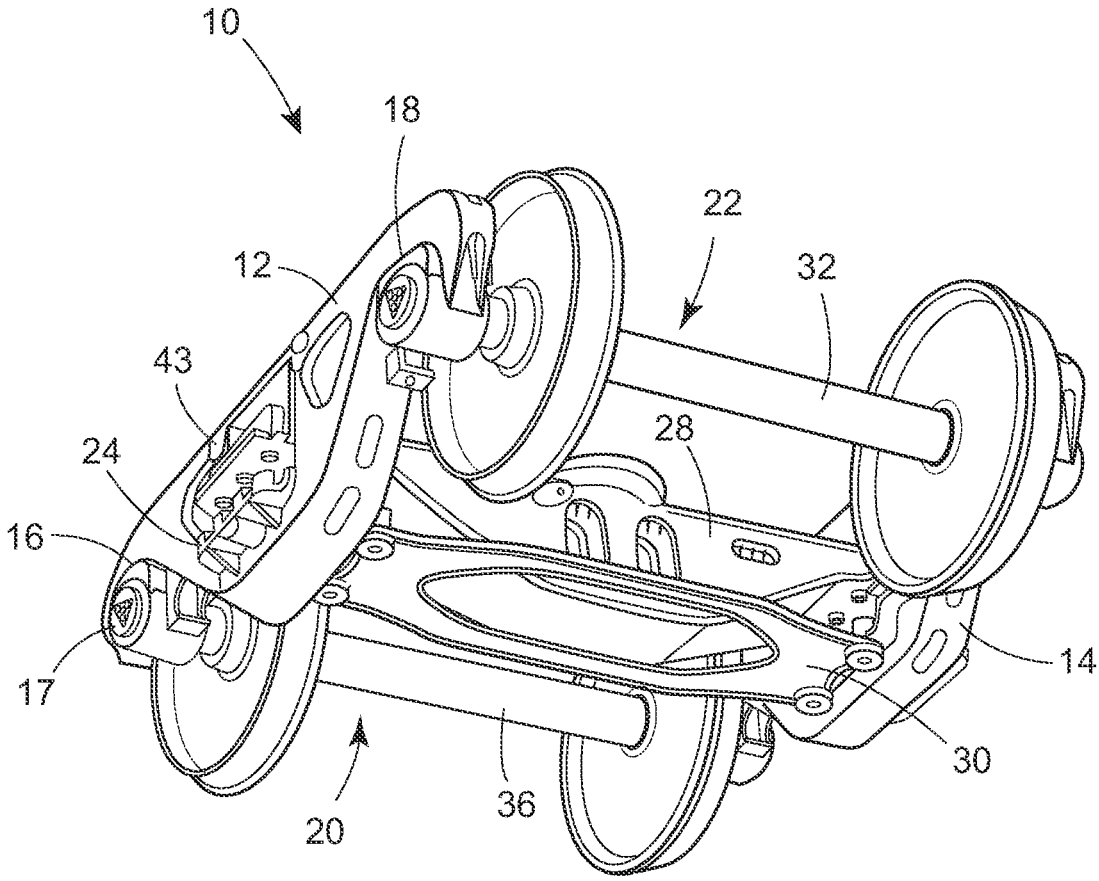
FIG. 1 is an isometric view of a three piece truck incorporating a novel transom according to an embodiment of the invention.

In the embodiment depicted in FIG. 1, railway car truck 10 comprises first and second side frames 12, 14, each having leading and trailing pedestal jaws 16, 18. In a square orientation, the first and second side frames are parallel, and the leading and trailing pedestal jaws are aligned to receive transversely mounted wheelsets 20, 22, so that the axles 32, 36 are parallel. Spring seat 24 is located in an opening 43 in the side frames. Precisely centering opening 43 in the side frame with respect to the pedestal jaws is expected to improve truck performance overall, when considered in combination with other improvements described herein.

Figure 6:
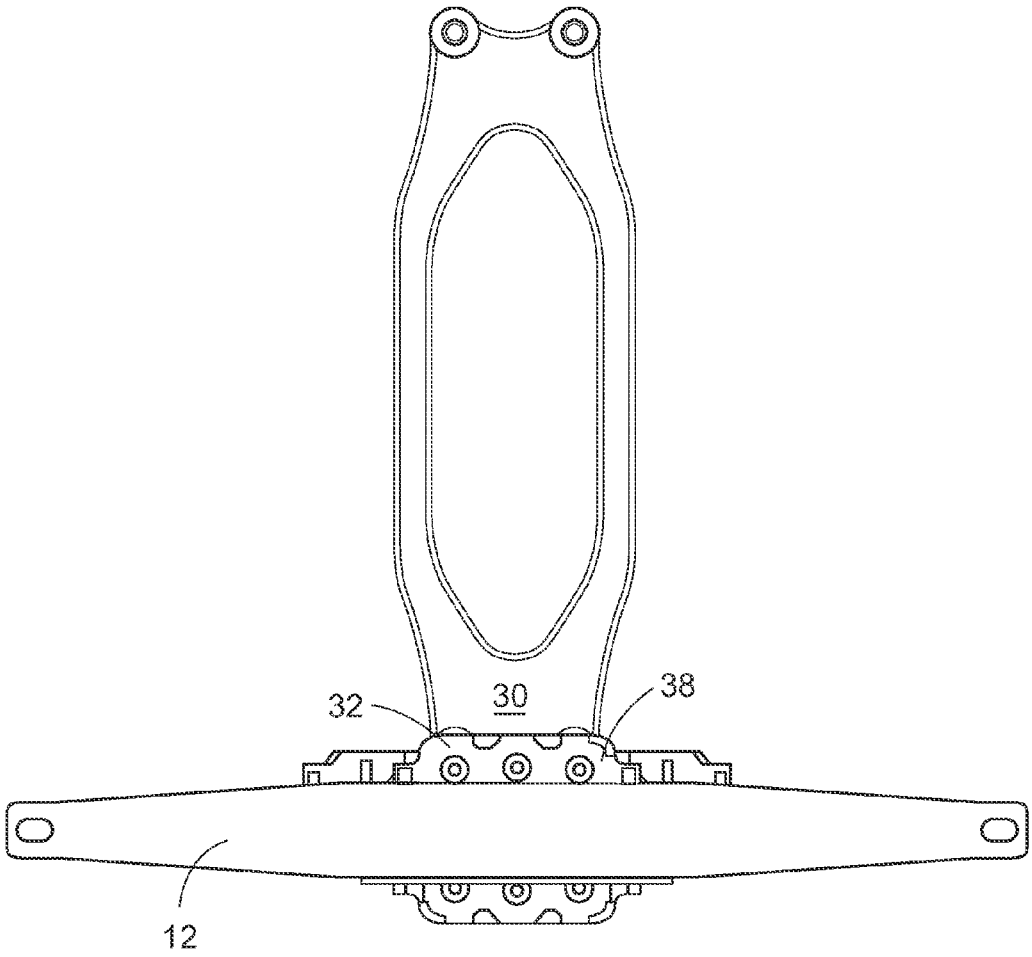
FIG. 6 is a top plan view of the side frame with parts of the truck removed, showing the attachment of the transom to the side frame.

An important feature of the invention is the attachment of the transom to existing real estate on a lower portion of the side frame. Viewed in plan as shown in FIG. 6, the spring seat wider than the rest of the side frame, forming a lip. This portion of the spring seat, referred to herein as the spring seat lip 38, extends inboard from the side frame in a cantilevered relationship to the side frame 12.

Figure 5:
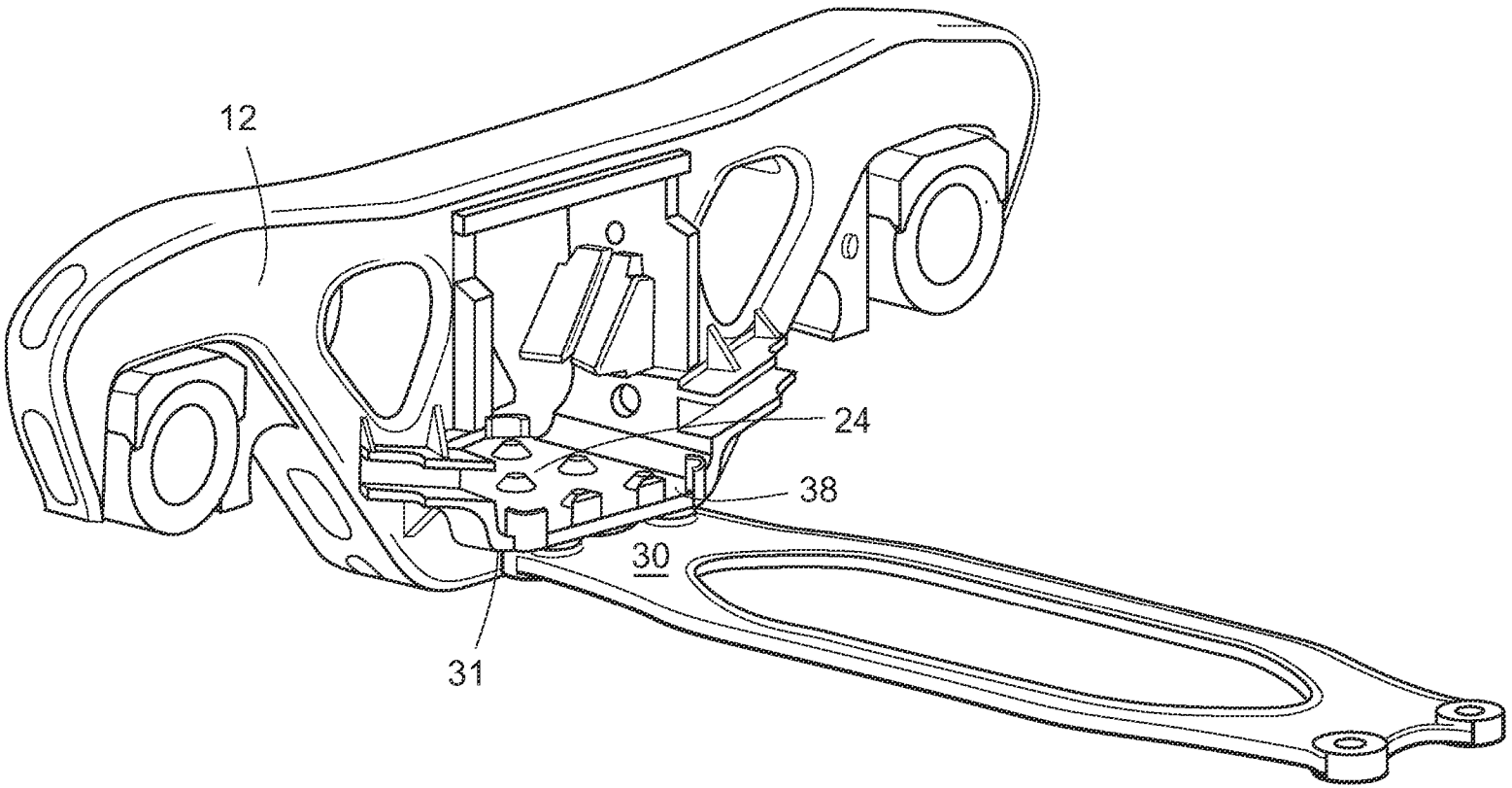
FIG. 5 is a detail view of the side frame and transom combination with parts of the truck removed to show the attachment of the transom below the spring seat lip.

As shown in FIG. 5, spring seat lip 38 cantilevered laterally inboard from a side wall of the side frame provides a ledge 31 on the underside of the spring seat for attachment of the transom 30. In embodiments, through holes are provided on the transom to bolt the transom to the side frame, so that the top surface of the transom contacts the bottom surface of the spring seat lips of the side frames. According to embodiments of the invention, the tops of the bolts are flush with the spring seat floor so as not to interfere with spring free-length or spring travel. Alternatively, the transom is welded or other attachment means are used so that the spring seat floor is free of interference.

FIG. 3 is an isometric view of the transom according to an embodiment of the invention, in which through holes 32 are provided on the periphery of the transom. The through holes are preferably reinforced so that the thickness of an area 51 around the through holes is greater than in other areas of the transom body. Thus, in the embodiment depicted in FIG. 3, the thickness of an area 51 surrounding the through holes may be about 2.0 to 4.0 times thicker than in an adjacent area. Likewise, the thickness of the ribs 42 and 44 which define the outside shape and the central cutout section 46 of the transom may be about 2.0 to 4.0 times greater than the thickness of the area between the ribs. A suitable combination of stiffness and torsional flexibility is obtained according to an embodiment of the invention where the ribs 42 and 44 have a thickness in a range of about 1.00 to 2.50 inches overall, preferably about 2.00 inches, and the reinforced areas 51 around the through holes have a thickness in a range of about 1.00 to 2.50 inches, preferably about 2.00 inches and where the major body of the transom 30 has an overall thickness in a range of about 0.25 to 1.00 inches, preferably about 0.50 inches. Although the depicted embodiment includes ribs around the periphery of the transom and around the central cutout section 46, other rib configurations are contemplated which yield a comparable combination of stiffness and torsional flexibility. The transom is preferably made of steel, but other metals and materials may be used without departing from the scope of the invention.

Lateral and longitudinal forces are transferred between the transom and the side frames via an elastomeric material. In one embodiment, the elastomeric material is provided in the through holes of the transom. As seen in in the cross sectional view of FIG. 4, bushing 40 in the through hole has an outer shell of elastomeric material 45 contacting the vertical side walls of the through hole, while a central metal tube 47 of the bushing permits the attachment bolt (not shown) to slide easily in the through hole. Preferably, the elastomeric material is a conventional rubber material, including without limitation, isoprene, neoprene, butadiene, styrene butadiene rubber and the like. The selection of the specific elastomeric material may be left to one of ordinary skill in the art. The materials are selected such that longitudinal and lateral spring rate achieved with the bushings according to the invention is between 30,000 and 100,000 lb/in, preferably 44,000 lb/in. Vertical spring rate is less than 10,000 lb/in preferably 7,000 lb/in. It is preferred that the ratio of longitudinal or lateral spring rate to vertical spring rate is about 6.0 or greater. The configuration of the elastomeric materials is also determined largely by the necessity to obtain the desired spring rate and ratio of lateral to vertical stiffness. In embodiments of the invention, the elastomeric material is in the form of a bushing with an outer diameter (which is also the diameter of the through hole) in a range of about 1.5 to 3.5 inches, preferably about 2.25 inches, and the elastomeric material has an annular thickness at the widest point in a range of about 0.25 inch to about 0.60 inch.

Other arrangements may provide an elastic member which transfers longitudinal and lateral force between the side frame and the transom. For example, in another embodiment (not shown in the drawings), a second lip is attached below the spring seat lip 38 on the side frame 12, forming a pocket for receiving a side of the transom. Elastomeric shock-absorbing material is provided in the pocket contacting a vertical and/or horizontal surface of the transom.

Transom 30 is constructed and installed so as not to interfere with the clearance between the bottom of the truck and the track. AAR specifications require a fully loaded railway car to have a nominal clearance of 4⅞ inches and a minimum clearance in worn conditions of 2¾ inches between the top of the rail and the bottom of the truck. Thus, according to the invention, the transom is designed to provide the required clearance in all conditions. The transom is designed such that the bolster 28 is received in a central cutout section 46 of the transom 30, such that the transom 30 does not interfere with movement of the bolster through the bolster's range of operating movement. Describing the particular embodiment of FIG. 3, the transom has a long dimension in the transverse direction of about 65 inches, measured from the centers of the through holes. A short dimension in the longitudinal direction of the truck, measured at the center of the transom, is about 22 inches, and about 11 inches measured between the centers of the through holes.

The transom is provided with a central cutout section 46, defined by a raised rib 44 in the embodiment shown, such that generally parallel edges of the cutout section on the leading and trailing sides of the cutout are tapered by a first gentle radius 49, meeting at a sharper radius 53 at opposed lateral sides of the cutout section. The width of the cutout section (i.e., the distance between the parallel sides) is preferably at least about 18 inches to allow clearance of the bolster at maximum loading.

In the embodiment shown, rib 42 defines the outside shape of the transom 30. The shape of the transom, the shape of the central cutout section, and the relative dimensions of the ribs are selected so that the transom has sufficient torsional flexibility to meet and surpass AAR load equalization standards, while still providing adequate rigidity to the truck to prevent parallelogramming.

Truck performance for rail cars is governed by AAR Specification M-976, which specifies requirements for hunting, steady state curving, curve resistance, spiral negotiation, and response to car body twist and roll, pitch and bounce, and yaw and sway. The best truck performance improvement in connection with these tests is achieved when a transom according to the invention or other means of constraining parallelogramming is combined with a modified bearing adapter as described in the aforesaid application Ser. No. 13/600,693, filed on even date herewith. The transom provides a high rigidity laterally and longitudinally and a softer spring rate vertically, as described above. The modified bearing adapter, on the other hand, provides a relatively high spring rate in the longitudinal direction between the side frame and the bearing adapter, and a relatively low spring rate in the lateral direction. In one embodiment, referring to the side view of FIG. 2, a bearing adapter is shown received in the pedestal jaw, with a curved surface facing roller bearing 17 and a flat surface facing the roof of the pedestal jaw. Elastomeric members 19 are positioned between the bearing adapter and the thrust lugs on the leading and trailing side walls of the pedestal, while a low friction surface interface, such as Teflon® (polytetrafluoroethylene), is provided between the pedestal roof and the top of the bearing adapter. The transom of the invention may also be used with a conventional truck, where the interface of the bearing adapter and the pedestal roof is steel-on-steel. Alternatively, the transom of the invention may also be used in trucks in which an elastomeric member is provided on the top surface of the bearing adapter between the bearing adapter and the pedestal roof.

Figure 7:
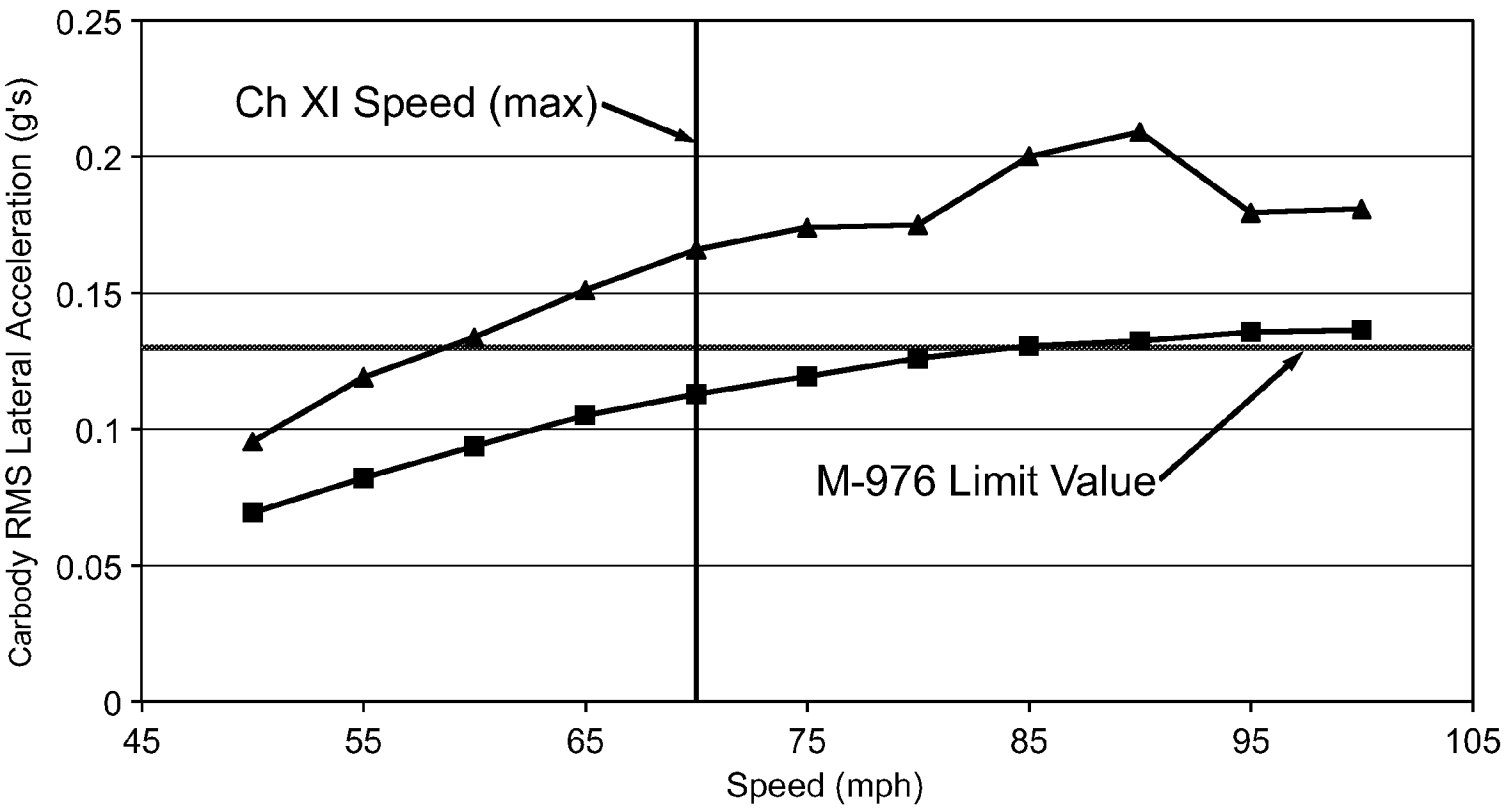
FIG. 7 is a graphic depicting the result of a computer simulation modeling RMS lateral acceleration of a railway car body as a function of car velocity, for a truck according to the invention and a truck according to the prior art.

FIG. 7 depicts the results of a computer simulation which models the performance advantages achieved with a truck having a transom as described above in FIG. 3, as compared with a prior art truck. The outer dimensions of the modeled transom are about 65 inches by about 11 inches, measured from through hole center to through hole center, and about 22 inches in the longitudinal direction at the center of the transom. The central cutout section 46 was defined by a raised rib 44 forming a closed shape having tapered lateral sides and a distance in a longitudinal direction of about 18 inches between the parallel edges on the leading and trailing sides of the cutout section. The area around the through holes are reinforced as described above, having a thickness of 1.88 inch and the thickness of the transom toward the center, between the ribs, was about 0.5 inch. The modeled truck included a low friction interface between the bearing adapter and the side frame and elastomeric members positioned longitudinally with respect to the bearing adapter.

The vertical axis of FIG. 7 represents the root mean square lateral acceleration of the car body just above the point where the truck meets the car body. This lateral acceleration back and forth represents hunting behavior and is known to increase at higher speeds. AAR specifications require the specified levels to be met at velocities up to and including 70 miles per hour, indicated by the vertical line toward the center of the graphic, labeled "Ch. XI Speed (max)" This refers to Chapter XI of AAR MSRP Section. C, referred to in the AAR M-976 specification. The horizontal line in the middle of FIG. 7 represents the M-976 limit value for lateral acceleration. Thus, the lower left quadrant of FIG. 7 represents trucks meeting the test requirements of the current standard.

The upper line, with data points represented by solid triangles, represents a model of a current M-976 truck without a transom according to the invention. The lower line, with data points represented by solid squares, represents data modeled on a truck according to the invention, including a transom and elastomeric members positioned longitudinally with respect to the bearing adapter between the side frame and the bearing adapter. The truck according to the invention exhibits significantly greater resistance to hunting and a higher hunting threshold, exhibiting lateral acceleration below the M-976 limit value well above the velocity required in the Standard.

One of ordinary skill in the art will recognize that other modeling may be used to obtain information about other performance criteria, and that such performance criteria may be impacted by other components of the truck. Trucks meeting the M-976 standard may have different components. Moreover, computer modeling is no substitute for testing on actual track in real world conditions, and AAR specifications require the results of such testing to be gathered over thousands of miles before a truck is approved. However, the modeling described above is commonly used and relied upon as a directional indicator of truck performance. While many factors impact the performance of the truck in the computer model, the improved hunting behavior of the truck can be attributed mostly to the innovative transom design. Reference herein to an AAR standard refers to the standard in effect on the filing date of this application.

The above description of the preferred embodiments is not to be deemed limiting of the invention, which is defined by the following claims.

What is claimed is:

1. A railway car truck, comprising:

first and second side frames each having a leading pedestal jaw and a trailing pedestal jaw, said first and second side frames being in opposed relationship and parallel, and respective leading and trailing pedestal jaws being aligned to receive transversely mounted leading and trailing wheel sets, respectively;

first and second spring seats located between the leading and trailing pedestal jaws, and first and second spring seat lips cantilevered laterally inboard from a side wall of each side frame at the respective spring seats;

a bolster arranged transversely between the first and second side frames, said bolster being supported on springs received in the spring seats;

a transom attached to the first and second side frames and having a central cutout section receiving a lower portion of the bolster through the cutout section of the transom, wherein the transom is attached to the side frame below each respective spring seat lip; and an elastomeric shock-absorbing material transferring lateral and longitudinal force between the transom and the side frame.

2. The railway car truck according to claim 1, wherein the transom is provided with raised ribs reinforcing the transom.

3. The railway car truck according to claim 1, wherein the transom is provided with a raised rib defining a closed shape around the central cutout section.

4. The railway car truck according to claim 1, wherein the transom has a long dimension in the transverse direction of the truck and a short dimension in the longitudinal direction of the truck, and the central cutout section is at least about 18 inches at its widest point in the longitudinal direction to accommodate the bolster.

5. The railway car truck according to claim 1, wherein the transom comprises through holes proximate the periphery of the transom, and an elastomeric bushing in each through hole, and further comprising bolts passing through each bushing and bolted to the bottom surfaces of the respective spring seat lips.

6. The railway car truck according to claim 5, wherein the transom has four corners and one through hole at each corner, and wherein the bushings inserted in each through hole comprise a central metal tube allowing passage of a bolt therethrough.

7. The railway car truck according to claim 1, having a reinforced area around each through hole of the transom which is 2.0 to 4.0 times is thicker than an adjacent area of the transom.

8. The railway car truck according to claim 1, wherein a raised rib defining the central cutout section has a thickness in a range of about 1.0 inch to about 2.5 inches, and the thickness of the transom in an area between the ribs is in a range of about 0.25 inch to about 1.0 inches, and ribs are about 2.0 to about 4.0 times thicker than the area of the transom between the ribs.

9. The railway car truck according to claim 1, further comprising a bearing adapter received in each pedestal jaw, said bearing adapter mating with thrust lugs on leading and trailing sides of the pedestal jaw; and having elastomeric members positioned between the bearing adapter and the thrust lugs applying spring force to control longitudinal and lateral motion between the side frame and the bearing adapter.

10. The railway car truck according to claim 1, comprising a bearing adapter received in each pedestal jaw, and an elastomeric pad between the roof of the pedestal jaw and a top surface of the bearing adapter.

* * * * *